US009553368B1

(12) United States Patent
Tonn

(10) Patent No.: US 9,553,368 B1
(45) Date of Patent: Jan. 24, 2017

(54) MULTI-BAND CABLE ANTENNA WITH IRREGULAR REACTIVE LOADING

(71) Applicant: David A. Tonn, Amston, CT (US)

(72) Inventor: David A. Tonn, Amston, CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 213 days.

(21) Appl. No.: 14/532,063

(22) Filed: Nov. 4, 2014

(51) Int. Cl.
*H01Q 9/14* (2006.01)
*H01Q 9/30* (2006.01)

(52) U.S. Cl.
CPC ..... *H01Q 9/145* (2013.01); *H01Q 9/30* (2013.01)

(58) Field of Classification Search
CPC ..... H01Q 5/0034; H01Q 5/321
USPC ..... 343/722, 745, 749, 750
See application file for complete search history.

(56) References Cited

U.S. PATENT DOCUMENTS 4,442,436 A * 4/1984 Newcomb ..... H01Q 5/321 343/722
4,764,773 A * 8/1988 Larsen ..... H01Q 1/1285 333/25
4,806,944 A * 2/1989 Jacomb-Hood ..... H01Q 3/26 343/745
4,939,525 A * 7/1990 Brunner ..... H01Q 9/36 343/708
6,429,821 B1 * 8/2002 Lewis, Jr. ..... H01Q 5/00 343/749
7,834,814 B2 * 11/2010 Xie ..... H01Q 1/243 343/749

* cited by examiner

*Primary Examiner* — Tho G Phan

(74) *Attorney, Agent, or Firm* — James M. Kasischke; Michael P. Stanley

(57) ABSTRACT

An antenna includes a first antenna section that can be joined to an antenna feed. The first section has conductive elements in series with reactive loads. The reactive loads are positioned with a regular spacing. The reactive loads and spacing are optimized for operation of the first section at the highest frequency. Additional antenna sections having successively lower frequencies are joined in series to the first antenna section. Each additional section has conductive elements joined in series with reactive loads at a particular spacing. The additional sections spacing and reactive loads are provided to work in conjunction with the higher frequency antenna sections to optimize the antenna for an additional frequency. A method for making such an antenna is further provided.

19 Claims, 3 Drawing Sheets

MULTI-BAND CABLE ANTENNA WITH IRREGULAR REACTIVE LOADING

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION (1) Field of the Invention

The present invention is directed to a linear buoyant antenna and a method for designing such an antenna to provide two different band capabilities in a single element.

(2) Description of the Prior Art

Buoyant Cable Antennas (BCAs) are a class of antennas unique to maritime applications. They consist of a straight insulated wire surrounded by a positively buoyant jacket material. The electrical performance of these antennas is somewhat limited owing to the underlying physics involved, and several antennas are often needed to obtain broadband frequency coverage. The present invention seeks to overcome this limitation by providing optimal multi-band performance in one single conductor antenna element.

Previous work on BCA improvements has led to antennas that have improved performance in the HF band (e.g. U.S. Pat. No. 7,868,833, entitled "Ultra wideband buoyant cable antenna element." This improvement was only possible in a single portion of the radio spectrum and does not allow for improved performance in both the High Frequency (HF) and Very High Frequency (VHF) bands.

The use of a modular approach is disclosed in U.S. Pat. No. 8,203,495, entitled "Modular VLF/LF and HF buoyant cable antenna and method." This teaches that low frequency signals can be received on the braid of a piece of coaxial cable that is connected in series with the HF antenna. The method taught only allows for improvements the performance of the HF antenna.

SUMMARY OF THE INVENTION

It is a first object of the present invention to provide an antenna capable of operating in several bands;

Another object is to provide such an antenna having a single conductive element; and Yet another object is to provide a method for making a multiband single element antenna.

Accordingly, there is provided an antenna that includes a first antenna section that can be joined to an antenna feed. The first section has conductive elements in series with reactive loads. The reactive loads are positioned with a regular spacing. The reactive loads and spacing are optimized for operation of the first section at the highest frequency. Additional antenna sections having successively lower frequencies are joined in series to the first antenna section. Each additional section has conductive elements joined in series with reactive loads at a particular spacing. The additional sections spacing and reactive loads are provided to work in conjunction with the higher frequency antenna sections to optimize the antenna for an additional frequency. A method for making such an antenna is further provided.

BRIEF DESCRIPTION OF THE DRAWINGS

Reference is made to the accompanying drawings in which are shown an illustrative embodiment of the invention, wherein corresponding reference characters indicate corresponding parts, and wherein.

DETAILED DESCRIPTION OF THE INVENTION

Figure 1:
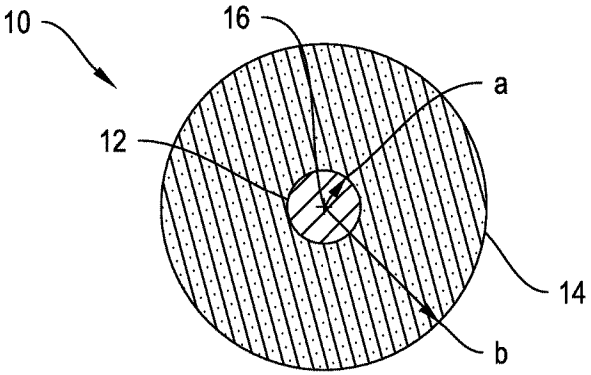
FIG. 1 is a cut away view of one embodiment of the antenna.

The present invention overcomes the limitations of prior antennas by employing an irregular loading profile along the length of a single conductor antenna. A cross-sectional view of the antenna is given in FIG. 1. The antenna 10 consists of an insulated solid conductor 12 of radius a. Preferably, this element is made from copper; however, any highly conductive metal could be used. The conductor 12 is surrounded by a low density polymer foam jacket 14 of circular cross section and of radius b. The axis 16 of the conductor 12 is arranged to be coincident with the axis 16 of the polymer foam jacket 14 so that the conductor 12 is centered in the jacket 14. The polymer jacket 14 is engineered to have as low a specific gravity and dielectric constant as possible. A low specific gravity allows improved flotation. A low dielectric constant is essential for optimal RF performance. Reactive elements (not shown, see FIG. 2 at 20A, 20B, 20N) are positioned in contact with wire 12 at the axis of jacket 14.

Figure 2:
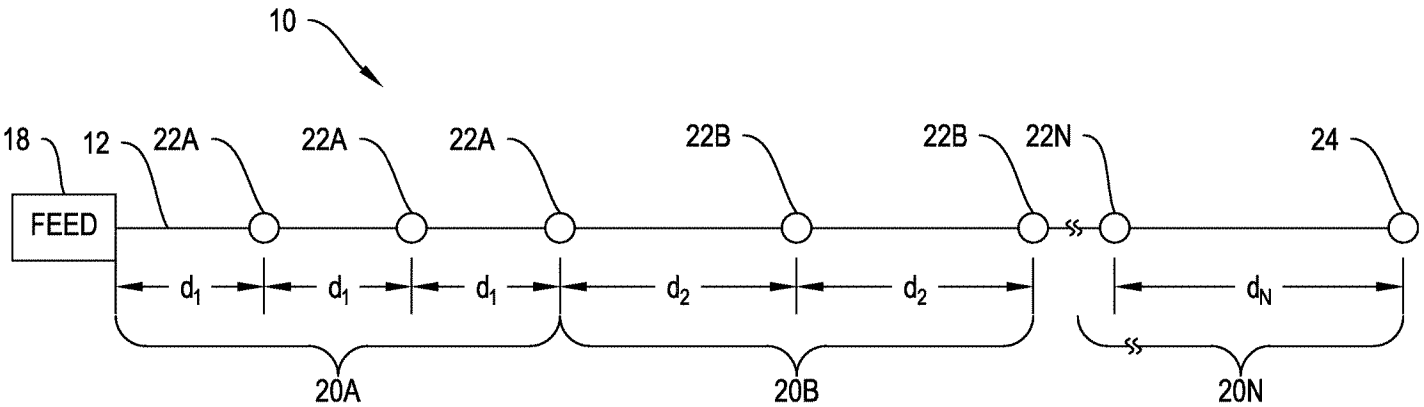
FIG. 2 is a diagram of a generic antenna.

FIG. 2 provides a generic diagram of the antenna 10. Antenna 10 is joined to a feed 18 which can be a receiver, transmitter or transceiver. Antenna 10 has sections identified as 20A, 20B and 20N. Reactive elements or loads, such as 22A, are regularly spaced along each section 20A in series with conductor 12. Within a section such as 20A, there is a separation distance $d_1$ between each reactive load 22A. Each section 20A, 20B . . . 20N has its own particular reactive loads 22A, 22B . . . 22N and its own particular reactive load spacing $d_1$, $d_2$ . . . $d_N$. The reactive loads 22A, 22B . . . 22N may take on a variety of forms, including a single capacitor, a single inductor, or a capacitor in parallel with an inductor. Generally, all of the reactive loads, except those in the last section of the antenna, such as 22N, include an inductor to provide current to the next, more distal section. Last section 22N can have a terminator 24 if required by the operating parameters of the associated band. For example, the VLF band requires that terminator 24 be a short circuit to allow environmental current flow.

The reactive loads 22A, 22B . . . 22N have a reactance as a function of frequency that is chosen in conjunction with their spacing $d_1$, $d_2$ . . . $d_N$ in such a manner as to control how current flows along the length of the antenna 10 in different bands so as to facilitate improved gain performance in those bands. (The linear dimension of reactive loads 22A, 22B . . . 22N is actually very small and does not have any effect on spacings.) The complicated nature of the loading often requires the use of optimization code; for this purpose, a multiobjective genetic algorithm has been developed which allows the optimal gain-bandwidth tradeoff to be mapped. Other types of optimization can be performed utilizing general purpose computing resources.

Figure 3:
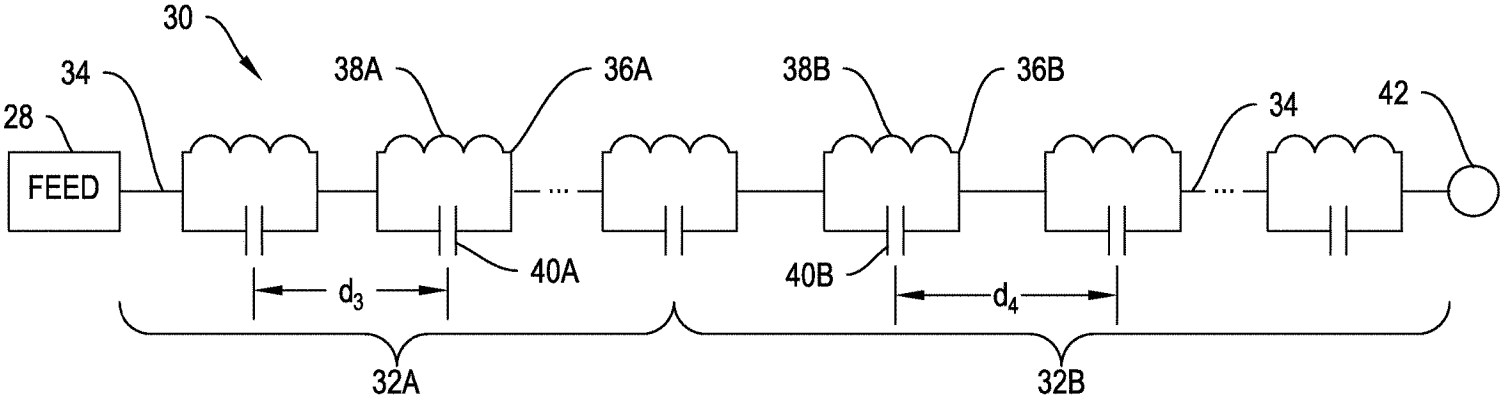
FIG. 3 is a diagram showing an embodiment of the linear multi-band antenna.

FIG. 3 shows a first embodiment. In this embodiment, feed 28 is joined to an antenna 30 which consists of two sections 32A and 32B. The first section 32A is a three meter long section of #18 AWG conductor segments 34 having reactive loads 36A comprising a 0.1 pH inductor 38A in parallel with a 47 pF capacitor 40A placed in series along the first section 32A. In this embodiment $d_3$ is 0.16 meters. The second section 32B is a 19 meter long section of #18 AWG wire conductor segments 34 having a reactive load 36B which is a 100 pF capacitor 40B in parallel with a 5.6 pH inductor placed spaced apart in series along the second section 32B with $d_4$=1 m. A terminator 42 is provided at the distal end of the antenna 30.

The first section 32A was optimized for maximum gain in the VHF band near 110 MHz; and the second section 32B was optimized to work in concert with the first section 32A to give optimal gain in the HF band, focused on the frequencies in the band from about 20-24 MHz. These frequencies are dependent on the project and other frequencies can be used. This method can be used to shift the focus frequencies elsewhere in the band as needed by adjusting the distances and reactive load values. Preferably, this is performed by utilizing the multiobjective genetic algorithm as discussed previously; however, other methods can be utilized.

Figure 4:
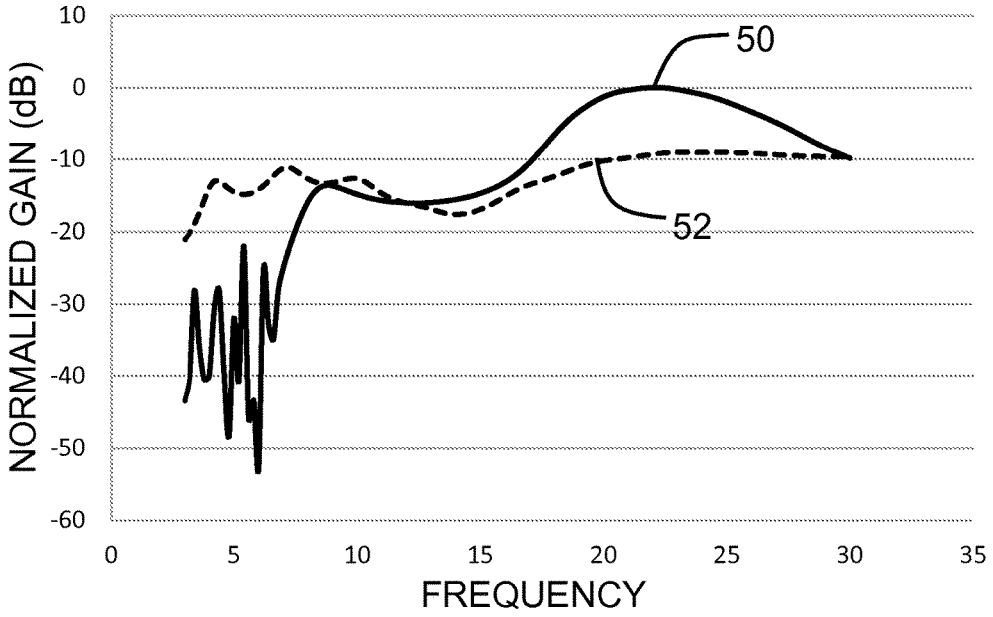
FIG. 4 is graph showing normalized performance gains of the current antenna over a prior art antenna for the HF band.
Figure 5:
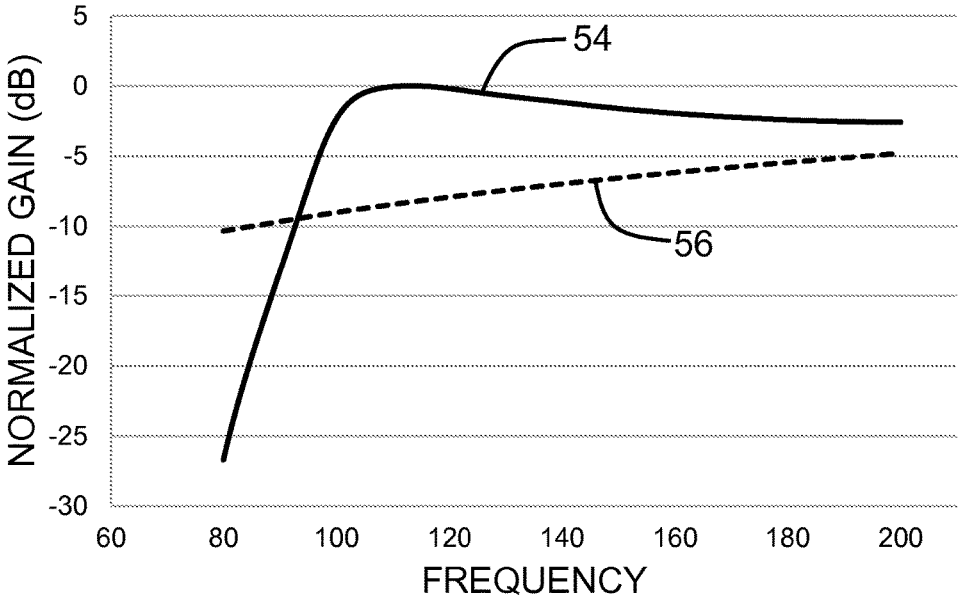
FIG. 5 is a graph showing normalized performance gains of the current antenna over a prior art antenna for the VHF band.

In FIG. 4, the computed gain of this antenna in the HF band is shown as solid line 50. For reference, the computed gain of a straight insulated antenna is shown as dashed line 52 to illustrate the improvement in gain that can be obtained utilizing reactive loads. (The noise at the lower frequencies in FIG. 4 is caused by computational issues in modeling. It is expected that the actual gain will be smoother in this frequency range.) Note that the data in each plot of FIG. 4 and FIG. 5 have been normalized to a maximum value of 0 dB. In FIG. 5, the computed gain of this antenna in the VHF band as shown as solid line 54. The computed gain of the straight insulated antenna is shown as dashed line 56. These graphs indicate that gain is improved by as much as 5 dB at some frequencies.

It is an important aspect of this embodiment that the VHF section precedes the HF section. In other words, the VHF section must sit between the feed and the HF section. Otherwise, the current from the feed is attenuated by the HF section and reduces the realized gain of the antenna in the VHF band.

In the more general form of this invention depicted previously in FIG. 2, a similar idea holds true. The first section 20A of the antenna 10 closest to the feed 18 is the section that functions in the highest frequency band, while the second section 20B functions in concert with the first section 20A to operate in the next highest band, etc. so that the last section 20N operates in concert with all of the sections before it to function in the lowest frequency band.

Figure 6:
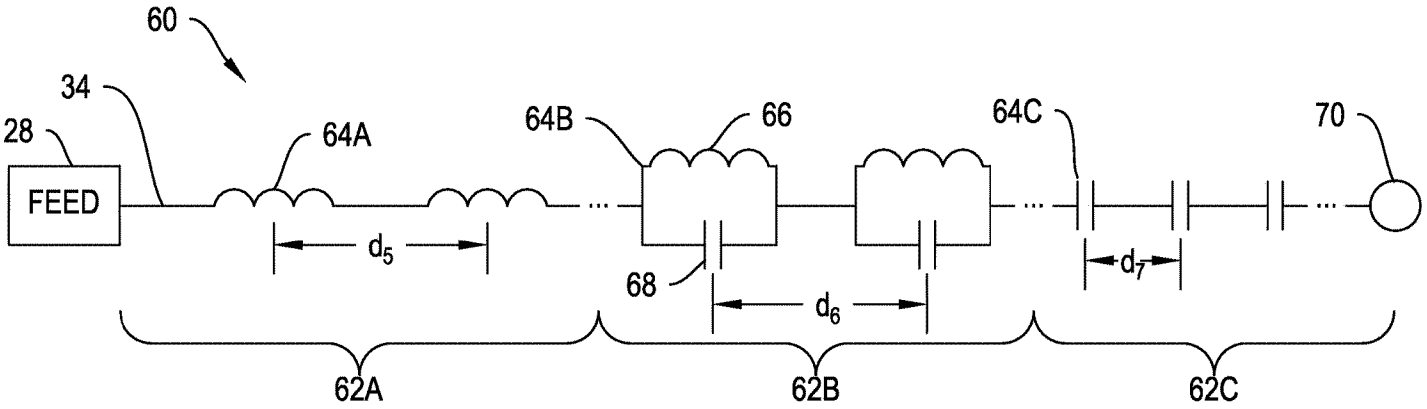
FIG. 6 is a diagram showing another embodiment of the linear multi-band antenna.

FIG. 6 shows an embodiment of the antenna 60 having three sections 62A, 62B and 62C. An antenna feed 28 is joined to the antenna 60 at first section 62A. First section 62A includes a plurality of conductor segments 34 being separated by reactive elements 64A. In this section, reactive loads 64A are inductors spaced at a distance $d_5$ apart from each other. The total length of first section 62A and the number and inductance value of reactive loads 64A is based on a first operating frequency. The total length is dictated by the wavelength of the received signal and the spacing $d_5$ is dependent on the number of reactive loads needed.

Second section 62B includes conductor segments 34 separated by reactive elements 64B. In this embodiment, reactive elements 64B include an inductor 66 wire in parallel with a capacitor 68. Reactive elements 64B are spaced apart a distance of $d_6$. The length, reactive element spacings and reactive element values of second section 62B are designed with first section 62A to be responsive to a second operating frequency.

The third section 62C has reactive elements 64C separated by conductor segments 34 at a distance of $d_7$. Reactive elements 64C are capacitors. Because third section 62C is the terminal section of antenna 60, third section 62C does not need inductive elements to provide current to ensuing, more distal sections. A terminator 70 can be provided at the end of third section. When dealing with low frequencies, terminator 70 must have electrical contact with the environment. As before, section 62C is designed for a particular frequency in conjunction with all of the other sections 62A and 62B between third section 62C and feed 28.

The irregular loading of the antenna conductor allows for the antenna to have optimized performance in more than one band of operation. This is a result that was not possible with a uniformly loaded antenna, where each of the loads was the same component and all of the loads were equally spaced. The irregular loading approach allows one section of the antenna to be optimized for one band, and then that portion, along with the one that follows it, can be optimized in a separate band of operation.

This type of antenna can take on several forms, depending on the types of reactive loads that are used and the spacing between these loads. Many embodiments are possible, including ones where the variation of reactance with position along the length of the antenna (referred to as the "loading profile" of the antenna) obeys a well-defined mathematical relationship.

In the preferred embodiment, the antenna has two sections, one optimized for VHF performance and using the parallel connection of a single capacitor and a single inductor at each load position, with a second section consisting of single capacitor loads uniformly spaced along the remaining length of the antenna.

In a second embodiment, the antenna consists of a multiple sections, each having reactive loads but where the product of the load capacitance and spacing on given section is one half that on the previous section. This implements an exponential taper in the loading profile and uses the method of the invention to improve the bandwidth of the antenna within a single band of operation. All of the sections except the final section must have components as part of the reactive loads that provide current to the sections further from the feed.

In a third embodiment, the antenna consists of a multiple sections, each having capacitive loads but where the product of the load capacitance and spacing on given section differs from that on the previous section by a fixed value, LCdz. This implements a linear taper in the loading profile. As with the other embodiments, the previous sections must have components that provide current to the sections further from the feed.

It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive, nor to limit the invention to the precise form disclosed; and obviously, many modification and variations are possible in light of the above teaching. Such modifications and variations that may be apparent to a person skilled in the art are intended to be included within the scope of this invention as defined by the accompanying claims.

What is claimed is:

1. An antenna capable of being joined to an antenna feed comprising:

a first antenna section having a proximate end joinable to the antenna feed and a distal end, said first antenna section having conductive elements and a plurality of first section reactive loads joined in series with the conductive elements at a first regular spacing, said first section reactive loads and regular spacing being provided to optimize operation of said first antenna section at a highest first frequency; and an ultimate antenna section having a proximate end joinable to the distal end of the previous more proximate antenna section, said ultimate antenna section having conductive elements and a plurality of ultimate section reactive loads joined in series with the conductive elements at an ultimate section regular spacing, said ultimate section reactive loads and said ultimate section regular spacing being provided to optimize operation of said ultimate antenna section along with all previous antenna sections at a lowest ultimate frequency.

2. The apparatus of claim 1 further comprising a polymer coating surrounding all conductive elements and all reactive loads in all sections.

3. The apparatus of claim 1 further comprising at least one intermediate antenna section having a proximate end and a distal end, said intermediate antenna section proximate end being joined to said previous antenna section distal end and having conductive elements and a plurality of intermediate section reactive loads joined in series with the conductive elements at an intermediate regular spacing, said intermediate section reactive loads and said intermediate regular spacing being provided to optimize operation of said intermediate antenna section along with all previous antenna sections at a frequency lower than that of the previous antenna sections.

4. The apparatus of claim 3 wherein said intermediate section reactive load comprises an inductor.

5. The apparatus of claim 4 wherein said intermediate section reactive load further comprises a capacitor joined in parallel with said inductor.

6. The apparatus of claim 3 wherein each antenna section has a load capacitance, and the product of the load capacitance and the regular spacing of each antenna section is a fixed proportion of the product of the previous antenna section.

7. The apparatus of claim 6 wherein the fixed proportion is one half.

8. The apparatus of claim 3 wherein each antenna section has a load capacitance, and the product of the load capacitance and the regular spacing of the section is a fixed value less than the product of the previous antenna section.

9. The apparatus of claim 1 wherein said first section reactive load comprises an inductor.

10. The apparatus of claim 9 wherein said first section reactive load further comprises a capacitor joined in parallel with said inductor.

11. The apparatus of claim 1 wherein said ultimate section reactive load comprises a capacitor.

12. The apparatus of claim 11 wherein said first section reactive load further comprises an inductor joined in parallel with said capacitor.

13. The apparatus of claim 1 further comprising a terminator joined to the distal end of said ultimate antenna section and making electrical contact with environmental fluid.

14. A method for building a multifrequency linear antenna comprising:

obtaining at least two design frequencies;

designing a linear antenna section for the highest design frequency by optimizing a first antenna section length, a number of reactive loads, and a number of reactive load values as optimized parameters; and designing additional linear antenna sections for each additional lower design frequency in conjunction with the antenna sections designed for higher frequencies by optimizing a total antenna length, a number of reactive loads for the additional antenna section, and reactive load values for the additional antenna segment as additional optimized parameters;

building a linear antenna section for the highest design frequency in accordance with the optimized parameters, said linear antenna section having a proximate end and a distal end;

building additional linear antenna sections for each additional frequency linear spacing in accordance with the additional optimized parameters, said additional antenna sections each having a proximate end and a distal end; and joining said additional linear antenna sections and said linear antenna section together such that the antenna sections proximate ends are joined to the distal ends of the antenna sections having a higher frequency, said linear antenna section for the highest design frequency being joinable to a feed.

15. The method of claim 14 wherein the step of designing additional linear antenna sections comprises:

determining a load capacitance and a regular spacing for a previous higher frequency antenna section; and designing the reactive load values and the regular spacing of the additional linear antenna section as a fixed proportion of the product of the load capacitance and the regular antenna spacing for the previous antenna section.

16. The method of claim 15 wherein the fixed proportion is one half.

17. The method of claim 14 wherein the step of designing additional linear antenna sections comprises:

determining a load capacitance and a regular spacing for a previous higher frequency antenna section; and designing the reactive load values and the regular spacing of the additional linear antenna section as a fixed value less than the product of the load capacitance and the regular antenna spacing for the previous antenna section.

18. The method of claim 14 wherein the steps of designing said linear antenna section and designing said additional antenna sections include optimizing the reactive load values and spacings utilizing a multiobjective genetic algorithm.

19. The method of claim 14 further comprising the step of coating said joined antenna sections with a polymer jacket.

* * * * *